US005751301A

United States Patent [19]

Saikawa et al.

[11] Patent Number: 5,751,301

[45] Date of Patent: May 12, 1998

[54] INK JET RECORDING APPARATUS HAVING INK JET HEAD MOVING STRUCTURE FOR GAP SPACING AND RECOVERY

[75] Inventors: Satoshi Saikawa, Inagi; Tetsuo Suzuki, Yokohama; Soichi Hiramatsu, Hachioji; Masahiro Taniguro; Hiroyuki Saito, both of Yokohama; Haruyuki Yanagi, Machida; Takashi Nojima, Tokyo; Hiroyuki Kinoshita, Kawasaki; Hideaki Kawakami, Yokohama, all of Japan

[73] Assignee: Canon Kabushiki Kaisha, Tokyo, Japan

[21] Appl. No.: 725,379

[22] Filed: Oct. 3, 1996

Related U.S. Application Data

[63] Continuation of Ser. No. 128,096, Sep. 29, 1993, abandoned.

[30] Foreign Application Priority Data

Oct. 2, 1992 [JP] Japan ..... 4-287116

[51] Int. Cl.[6] ..... B41J 2/165

[52] U.S. Cl. ..... 347/8; 347/32

[58] Field of Search ..... 347/8, 22, 29, 347/30, 32, 33, 37, 39; 400/55, 56, 59, 354

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,551,735 | 11/1985 | Suzuki et al. | 347/32 |
| 4,558,333 | 12/1985 | Sugitani et al. | 347/65 |
| 4,571,601 | 2/1986 | Teshima | 347/33 |
| 4,657,415 | 4/1987 | Kikuchi et al. | 400/59 |
| 4,723,129 | 2/1988 | Endo et al. | 347/56 |
| 4,734,719 | 3/1988 | Suzuki | 347/32 |
| 4,740,796 | 4/1988 | Endo et al. | 347/56 |
| 5,000,590 | 3/1991 | Einem | 400/55 |
| 5,153,613 | 10/1992 | Yamaguchi et al. | 347/30 |
| 5,177,505 | 1/1993 | Sugiura et al. | 347/22 |
| 5,187,497 | 2/1993 | Hirano et al. | 347/8 |
| 5,227,809 | 7/1993 | Carpenter et al. | 347/8 |
| 5,245,362 | 9/1993 | Iwata et al. | 347/23 |
| 5,322,377 | 6/1994 | Asai | 400/55 |

FOREIGN PATENT DOCUMENTS

| | | | |
|---|---|---|---|
| 0423475 | 4/1991 | European Pat. Off. . | |
| 0494674 | 7/1992 | European Pat. Off. . | |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 61-233544 | 10/1986 | Japan | 347/29 |

*Primary Examiner*—John E. Barlow, Jr.

*Attorney, Agent, or Firm*—Fitzpatrick, Cella, Harper & Scinto

[57] ABSTRACT

An ink jet recording apparatus, in which a recording head records on a recording medium disposed above a platen, includes a carriage for moving the recording head, a recovery mechanism having a contacting member, a guide shaft and a limiting mechanism. The guide shaft guides the carriage to a recording area and to a separate recovery area, and positions the recovery mechanism so that the contacting member is capable of contacting the surface of the recording head on which an ink discharge port is provided. The limiting mechanism has a guide surface and an elastic member, and limits the rotational movement of the carriage with respect to the guide shaft; the elastic member maintains the position of the carriage with respect to the platen at the recording area by applying an elastic force to the guide member.

34 Claims, 12 Drawing Sheets

INK JET RECORDING APPARATUS HAVING INK JET HEAD MOVING STRUCTURE FOR GAP SPACING AND RECOVERY

This application is a continuation of application Ser. No. 08/128,096 filed Sep. 29, 1993, abandoned.

BACKGROUND OF THE INVENTION

1. Field of the Invention

The present invention relates to an ink jet recording apparatus which performs the recording by discharging the ink onto the recording medium, and more particularly to a recovery mechanism for enclosing the ink discharge face of recording head and an ink jet recording apparatus having the recovery mechanism.

2. Related Background Art

In recent years, along with the spread of personal computers, word processors, or facsimile apparatuses into offices, various types of recording apparatuses have been developed as output means. Among them, an ink jet recording apparatus has been widely used because of its small size and the low recording noise.

In the ink jet recording apparatus, paper powder or dust may attach onto or around ink discharge orifices of recording head, or the ink may be thickened because ink water contents vaporize, causing the clogging of nozzles which yields an ink discharge failure. Thus, recovery means is provided for effecting the recovery operation for sucking the ink through ink discharge orifices via a cap member which is mounted on to the ink discharge orifices of the recording head to enclose them during the non-recording time, thereby maintaining the normal ink discharge operation.

An example of ink jet recording apparatus equipped with such recovery means will be described below with reference to FIGS. 11 to 13. FIG. 11 is a perspective view of ink jet recording apparatus, FIG. 12 is a cross-sectional view of recovery means, and FIG. 13 is a front view of recovery means. In FIG. 11, 50 is a recording head mounted on a carriage 51. The carriage 51 is slidably attached on the carriage shafts 53*a*, 53*b* disposed in parallel to the recording medium 52 so that it can be reciprocated on the carriage shafts 53*a*, 53*b* when driven by a carriage motor, not shown. 54 is a cap for use with recovery means which is brought into close contact with the ink discharge face when the recording head 50 is moved to a position opposed to the cap, and separated away from the ink discharge face when the recovery operation is ended. The cap 54 is caused to advance or retract when its back face side is forced by power transmission means, partially not shown, in accordance with the rotation of a cam 55 disposed rearward thereof, for example.

The cap 54 is held within a cap holder 56, which is held within a holder 57, as shown in FIG. 12. On the back face side (right side in FIG. 12) of the cap holder 56, a pin-like projection 58 is attached to extend through a partition wall of the holder 57. A coil spring 59 is fitted around the projection 58 between the cap holder 56 and the holder 57. This coil spring 59 has one end thereof on the partition wall of the holder 57, and the other end urging the cap holder 56 to place the surface of the cap 54 into contact with the ink discharge face of the recording head 50 at an appropriate pressure. Also, at the trailing end of the projection 58, an E ring 60 for regulating the forward movement of the cap 54 is attached.

On the upper surface of the holder 57 is provided a dowel portion 57*a*, and a coil spring 62 is extended between the dowel portion 57*a* and a dowel portion 61*a* of a flat cam 61, so that a cam face 61*b* of the flat cam 61 may abut on the dowel portion 57*a*. The holder 57 is mounted on a slider 63, which is moved in a left direction as shown in FIG. 11 along with the carriage 51 if a part of the recording head 50 comes into contact with an arm portion 63*a* of the slider 63. Then, since the dowel portion 57*a* of the holder 57 is moved upon abutting on the cam face 61*b* of the flat cam 61, the holder 57 is moved forward or toward the recording head 50, resulting in the cap 54 enclosing and protecting the ink discharge face of the recording head 50 to effect the suction recovery operation.

However, the ink jet recording apparatus is required to have a slide mechanism for moving the cap 54 on to the ink discharge face of the recording head 50, which is provided for cap pressing means on recovery means, and pressing means for pressing the cap 50 onto the ink discharge face. This applies not only to the ink jet recording apparatus of the serial type as described above, but also to the ink jet recording apparatus of the full-line type.

As a result, it is apprehended that recovery means becomes complex in structure, raising production costs with increased number of components and reducing the easiness of assembly because of small recovery means.

SUMMARY OF THE INVENTION

The present invention has been achieved to solve the aforementioned conventional problems, and its object is to provide an ink jet recording apparatus wherein a recovery mechanism is simplified with lower costs and the improved ease of assembly.

It is another object of the present invention to provide a recovery mechanism and an ink jet recovery apparatus having said recovery mechanism wherein a recording head movement mechanism for moving a recording head in a predetermined direction is provided with pressing means for pressing the ink discharge orifices of the recording head onto the recovery mechanism, so that the constitution of the recovery mechanism is simplified with the number of components reduced.

It is a further object of the present invention to provide a recovery mechanism and an ink jet recording apparatus having the recovery mechanism, wherein the recovery mechanism is capable of regulating the interval between the recording head and the recording medium, as well as preventing the vibration produced by pressing means for pressing the ink discharge orifices of recording head onto the recovery mechanism during the movement of the recording head.

DETAILED DESCRIPTION OF THE PREFERRED EMBODIMENTS

[First Embodiment]

Figure 1:
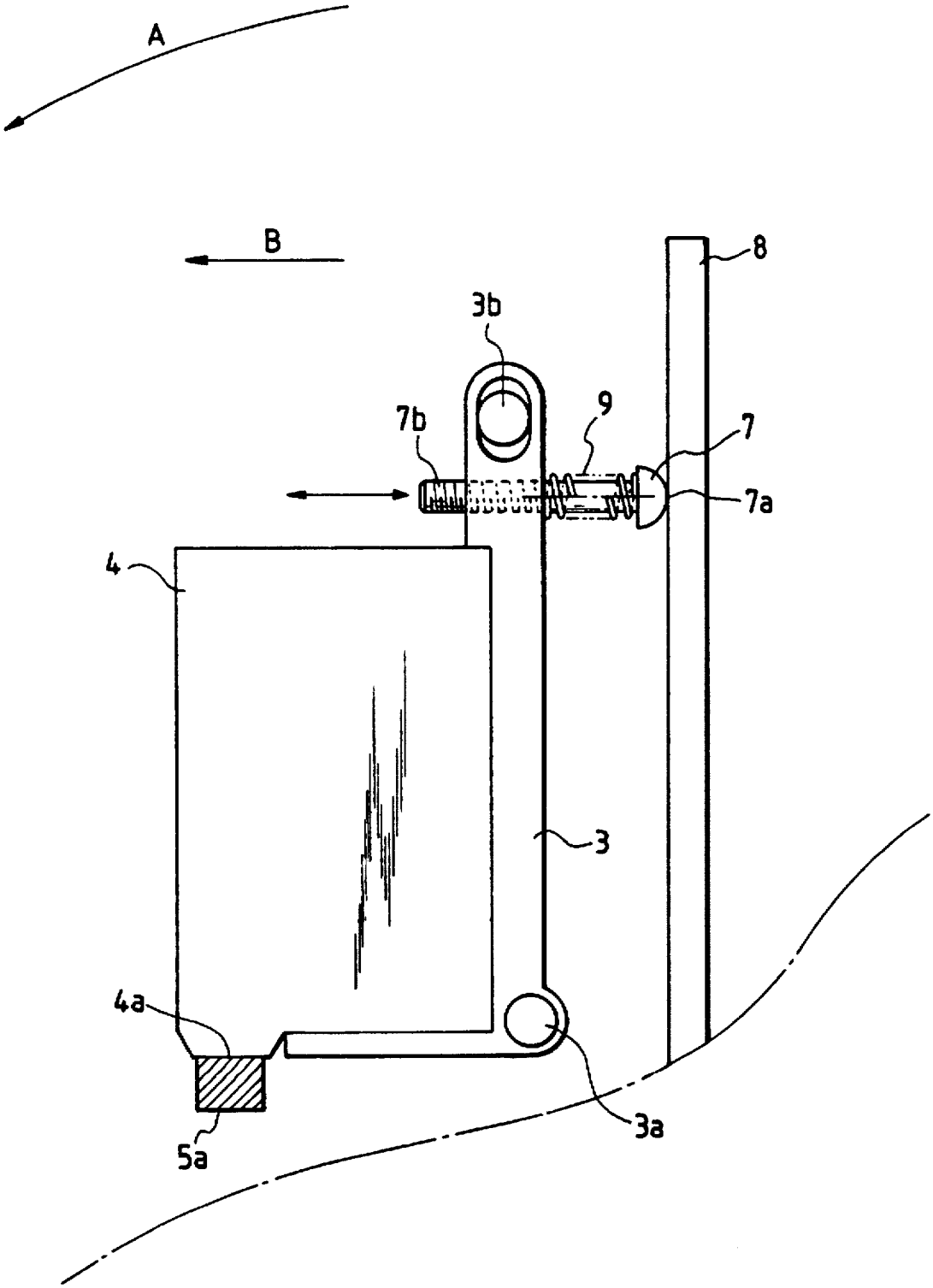
FIG. 1 is a schematic cross-sectional explanation view showing the constitution of pressing means provided on a carriage according to the first embodiment of the invention.
Figure 2:
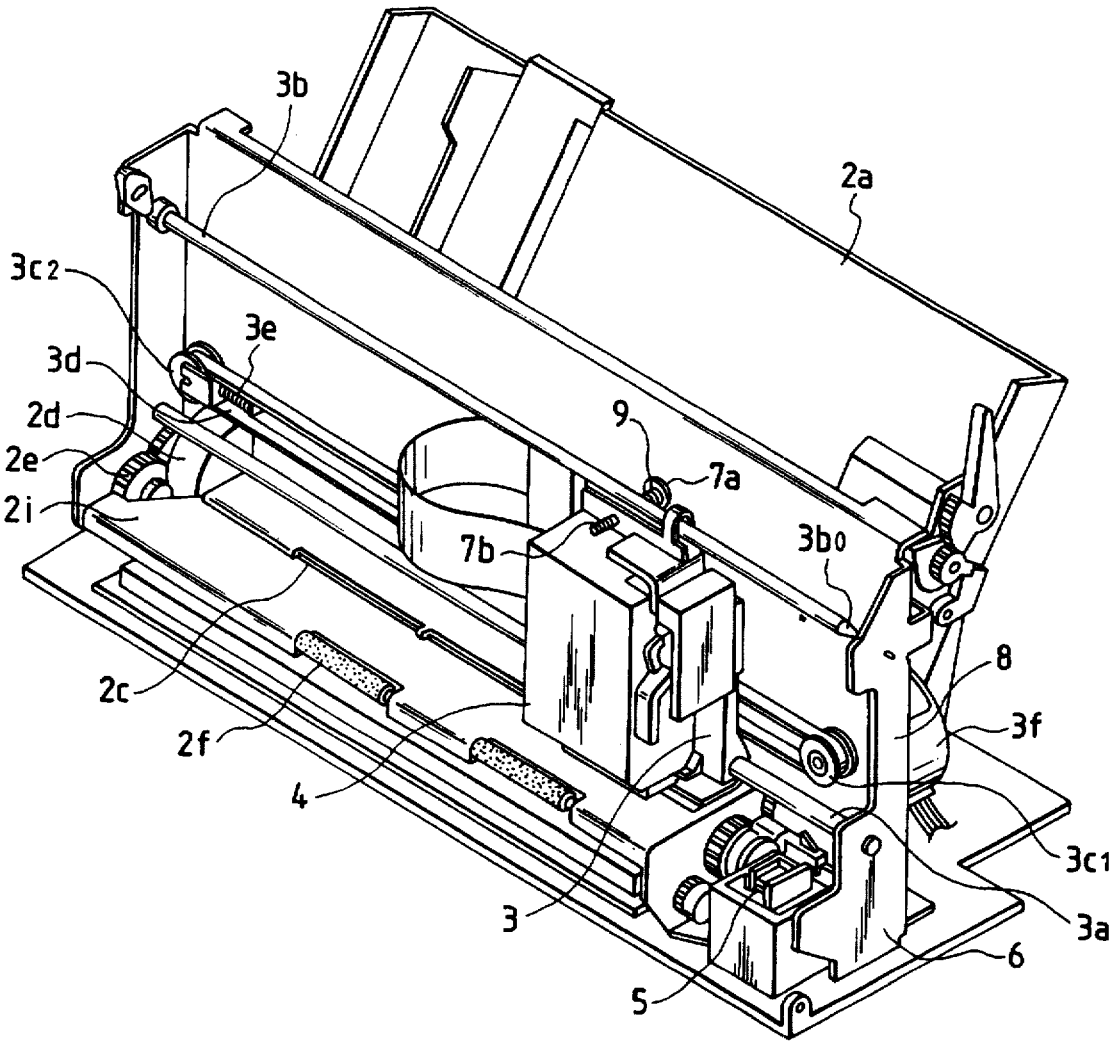
FIG. 2 is a schematic perspective explanation view of an ink jet recording apparatus according to the first embodiment of the invention.
Figure 3:
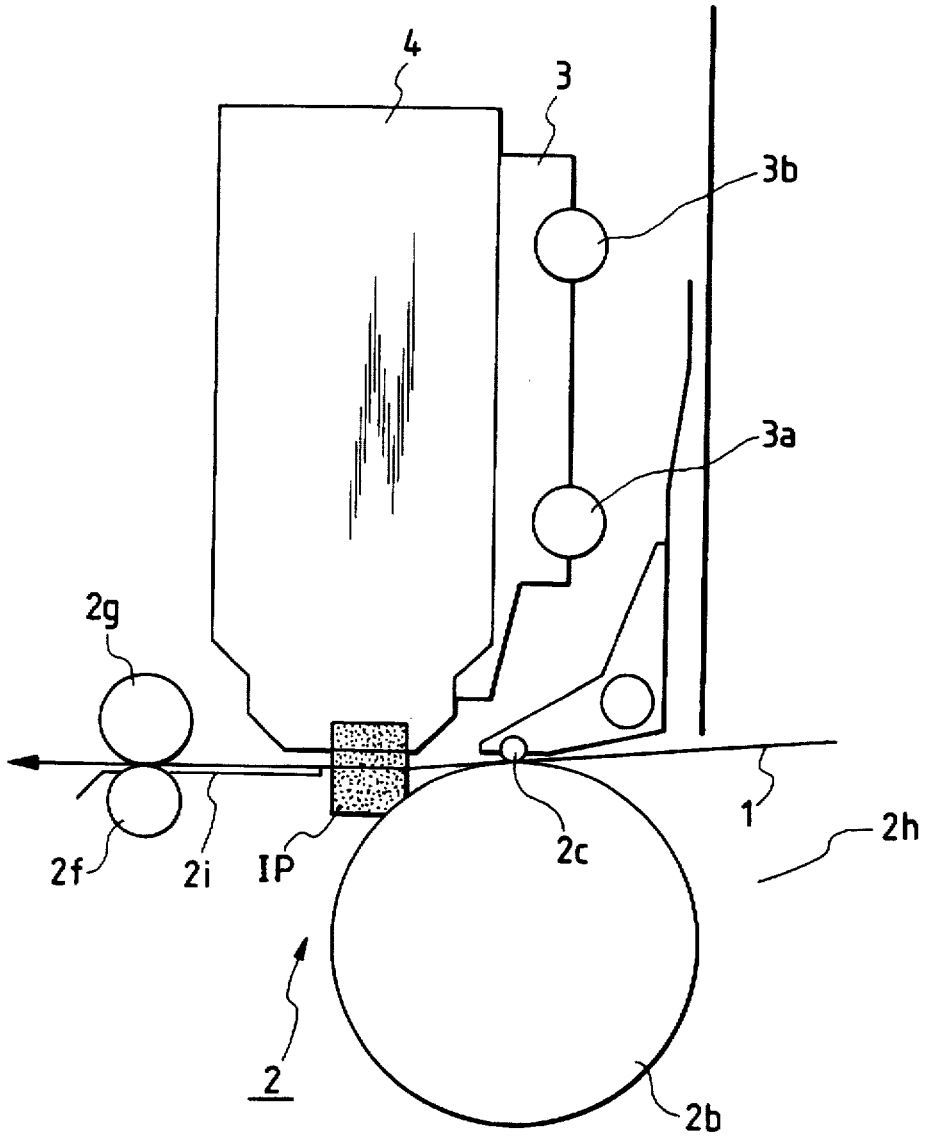
FIG. 3 is a schematic cross-sectional explanation view of the ink jet recording apparatus.

An ink jet recording apparatus according to the first embodiment of the present invention will be now described with reference to FIGS. 1 and 2. Note that FIG. 1 is a cross-sectional explanation view showing the constitution of pressing means provided on a carriage, FIG. 2 is a perspective explanation view of the ink jet recording apparatus, and FIG. 3 is a cross-sectional explanation view of the ink jet recording apparatus.

(Overall Constitution)

First, the overall constitution of the apparatus will be described below. This apparatus performs the recording by discharging the ink in response to an image signal in such a manner as to reciprocate a recording head 4 mounted on a carriage 3 with respect to the recording medium 1, while conveying a recording medium 1 (e.g., paper, cloth, OHP sheet, etc.) with conveying means 2. And the recording medium 1 after the recording is exhausted into a predetermined exhaust portion, and the recording head 4 is caused to be recovered by a recovery system 5. In the following, the constitution of each component will be described in sequence with reference to FIGS. 1 to 3.

(Conveying Means)

In FIG. 3, conveying means 2 conveys the recording medium 1 to a recording position IP, and exhausts the recording medium 1 into the exhaust portion after the recording. This apparatus allows for both the automatic sheet feeding with ASF (Automatic Sheet Feeder) and the manual insertion sheet feeding.

ASF sheet feeding is operable by setting recording sheets 1 on an ASF 2*a* mounted on an apparatus main body 6 as shown in FIG. 2 to have a recording sheet 1 at the nip between a conveying roller 2*b* and a pinch roller 2*c* driven for rotation by making contact therewith and apply a conveying force by driving for rotation the conveying roller 2*b*. Note that a driving force of the conveying motor 2*d* is transmitted via a gear train 2*e* to the conveying roller 2*b*.

Also, the recording medium 1 after the recording is exhausted into the exhaust portion by means of an exhausting roller 2*f* and a spur 2*g* driven for rotation by making contact therewith.

On the other hand, the manual insertion sheet feeding is operable by manually setting one sheet at a manual insertion opening 2*h* and convey it linearly by the driving of the conveying roller 2*b* and the exhausting roller 2*f*.

Downstream of the recording position of the recording head 4 in a conveying direction of the recording medium is provided a platen 2*i* which is a supporting member for supporting the back surface of the recording medium 2.

(Carriage)

In FIG. 2, the carriage 3 is recording head moving means for reciprocating the recording head mounted thereon, and is slidably attached on two guide shafts 3*a*, 3*b* extending along a direction orthogonal to the conveying direction of the recording medium 1.

A driving pulley 3*c*1 and a driven pulley 3*c*2 are attached near both ends of the guide shaft 3*a*, and a timing belt 3*d* engaged with the carriage 3 is looped between both pulleys 3*c*1, 3*c*2, and tensioned by a tension spring 3*e*. Also, a carriage motor 3*f* is connected to the driving pulley 3*c*1, and the carriage 3 is reciprocated along the guide shafts 3*a*, 3*b* by the forward or reverse rotations of the motor 3*f*.

(Recording Head)

The recording head 4 records an image onto the recording medium 1 conveyed by the conveying means 2 by discharging the ink thereto, wherein the recording head in this apparatus relies on an ink jet recording method for recording by discharging ink droplets. That is, this recording head 4 comprises minute liquid discharging openings (orifices), liquid channels having an energy acting portion provided on a part of this liquid channel, and energy generating means for generating liquid droplet forming energy which is applied to the liquid in the energy acting portion.

Energy generating means for generating such energy relies on a recording method of utilizing an electromechanical converter such as a piezoelectric element, a recording method of utilizing energy generating means for discharging liquid droplets by applying radiation of an electromagnetic wave such as a laser to heat liquid, or a recording method of utilizing energy generating means for discharging liquid droplets by heating liquid with electricity-heat converters such as heat generating elements having heat generating resistors.

Among them, an recording head relying on the ink jet recording method for discharging liquid droplets by the use of heat energy can perform the recording at high resolutions because of its high density arrangement of liquid discharge openings (orifices) for discharging liquid droplets formed to make the discharge by discharging liquid droplets for the recording. In particular, the recording head which uses electricity-heat converters as energy generating means is easily made compact, and is favorable because of making the effective use of the advancement of technologies in the recent semiconductor fields as well as the merits of the IC technology or micro process technology which has been remarkably improved in the respect of reliability, with the ease of high density packaging and the low manufacturing costs.

(Recovery Means)

Recovery means 5 prevents the clogging of the recording head 4 which may occur after the recording operation, comprising a capping mechanism for preventing an ink discharge failure with the recording head 4 as well as preventing the evaporation of water through the discharge orifices by placing a cap 5*a* made of an elastic material such as a rubber into contact with the ink discharge orifices of the recording head 4. Further, the recording means 5 includes a feature of making the discharging excellent by sucking the thickened ink through the ink discharge orifices by means of a pump so that the inside of the cap may be at the negative pressure. The recovery means 5 prevents the recording head 4 from having increased viscosity of the ink therein to lower the ink discharge rate or yield the clogging of the nozzles.

(Pressing Means)

As shown in FIG. 1, a sliding member 7 is inserted through a hole provided near the guide shaft 3*b* of the carriage 3 to be slidable in left and right directions as shown in the figure. This sliding member 7 comprises a pin-like slide portion 7*b* and a semi-spherical sliding portion 7*a* for sliding with its spherical face abutting on a chassis 8. A spring is fitted around the slide portion 7*b* between the carriage 3 and the sliding portion 7*a* to force the sliding portion 7*a* to the chassis 8. Note that the sliding portion 7*a* may be of a roll shape rolling on the chassis 8, but is not limited to them, as long as the sliding portion always makes contact with the chassis 8.

The slide portion 7*b* is urged in a direction of the arrow B due to a biasing force of the spring 9 because it is fitted loosely through the hole formed in the carriage 3. Also, when the cap 5*a* and the ink discharge face 4*a* of the recording head 4 are placed at opposed position to each other, it is necessary to place the ink discharge face 4*a* into close contact with the cap 5*a* by rotating the carriage 3 around the guide shaft 3*a* in a direction of the arrow A to press the ink discharge face 4*a* onto the cap 5*a*. Thus, the guide shaft 3*b* has a shaft diameter narrowed toward the right hand in FIG. 2 (3b0). The carriage 3 is brought to a site of the guide shaft 3b0 and the ink discharge face 4*a* is brought to a position opposed to the cap 5*a* and closer to the cap 5*a* to make contact therewith.

(Carriage Moving Operation)

The moving operation of the carriage 3 will be described below. The carriage 3 is connected to the timing belt 3*d* extended between the driving pulley 3*c*1 and the driven pulley 3*c*2, and reciprocated along the guide shafts 3*a*, 3*b* by driving the carriage motor 3*f*. And the recording head 4 records an image on the recording medium 1 by discharging the ink through the ink discharge orifices thereof in accordance with image information. After the completion of the recording, the carriage 3 is moved toward the recovery means side as shown in FIG. 2, and stopped at a position at which the ink discharge orifices of the recording head 4 and the cap 5*a* face each other (hereinafter referred to as a "capping position"). In this state, the ink discharge face 4*a* is completely enclosed with the cap 5*a*, with no small interstice left therein, wherein it is necessary to make a complete enclosed state by applying a pressure to the cap 5*a*.

Thus, the carriage 3 is urged in a direction of the arrow B owing to the spring 9 fitted between the carriage 3 and the sliding member 7, as shown in FIG. 1, and is rotated around the guide shaft 3*a* in a direction of the arrow A by virtue of having a shaft diameter of the guide shaft 3*b* narrowing at a capping position, as shown in FIG. 2, so that the ink discharge face 4*a* is placed into close contact with the cap 5*a*. Thereby, the ink discharge face 4*a* is enclosed with the cap 5*a*.

With the above constitution, it is unnecessary for the recovery means 5 to have pressing means for pressing the cap 5 on to the ink discharge face 4*a*, so that the recovery means 5 is simplified in construction with the improved easiness of assembly, and the apparatus can be reduced in whole size with the lower costs because of the reduced number of components.

[Second Embodiment]

A second embodiment other than the ink jet recording apparatus as shown in the first embodiment will be described below with reference to FIGS. 4 and 5. A schematic constitution of the ink jet recording apparatus is the same as that of the first embodiment, and the like numerals are attached to the like parts, the explanation of which is omitted.

This embodiment is configured such that a carriage 3 is recirpocated along a plate-like guide rail 8*a* formed by bending a part of a chassis 8 like a -character in cross section. In FIG. 4, on the upper face of the carriage 3 is attached a guide member 3*g* shaped as a -character in cross section, and a carriage sliding portion 3*h* is formed on a wall surface opposed to the guide rail 8*a* of the guide member 3*g* to be slidable therewith while abutting on the guide rails 8*a*. Also, the guide member 3*g* has a sliding member 7 inserted therethrough slidable in left and right directions in the figure. This sliding member 7 has a pin-like slide portion 7*b* and a semi-spherical sliding portion 7*a* for sliding with its spherical face abutting on the guide rail 8*a*. A spring 9 is fitted around the slide portion 7*b* between the guide member 3*a* and the sliding portion 7*a* to force the sliding portion 7*a* into contact with the guide rail 8*a*. Hence, the carriage 3 can be moved leftward or rightward with the guide rail 8*a* carried between the sliding portion 7*a* and the carriage sliding portion 3*h*.

Figure 5:
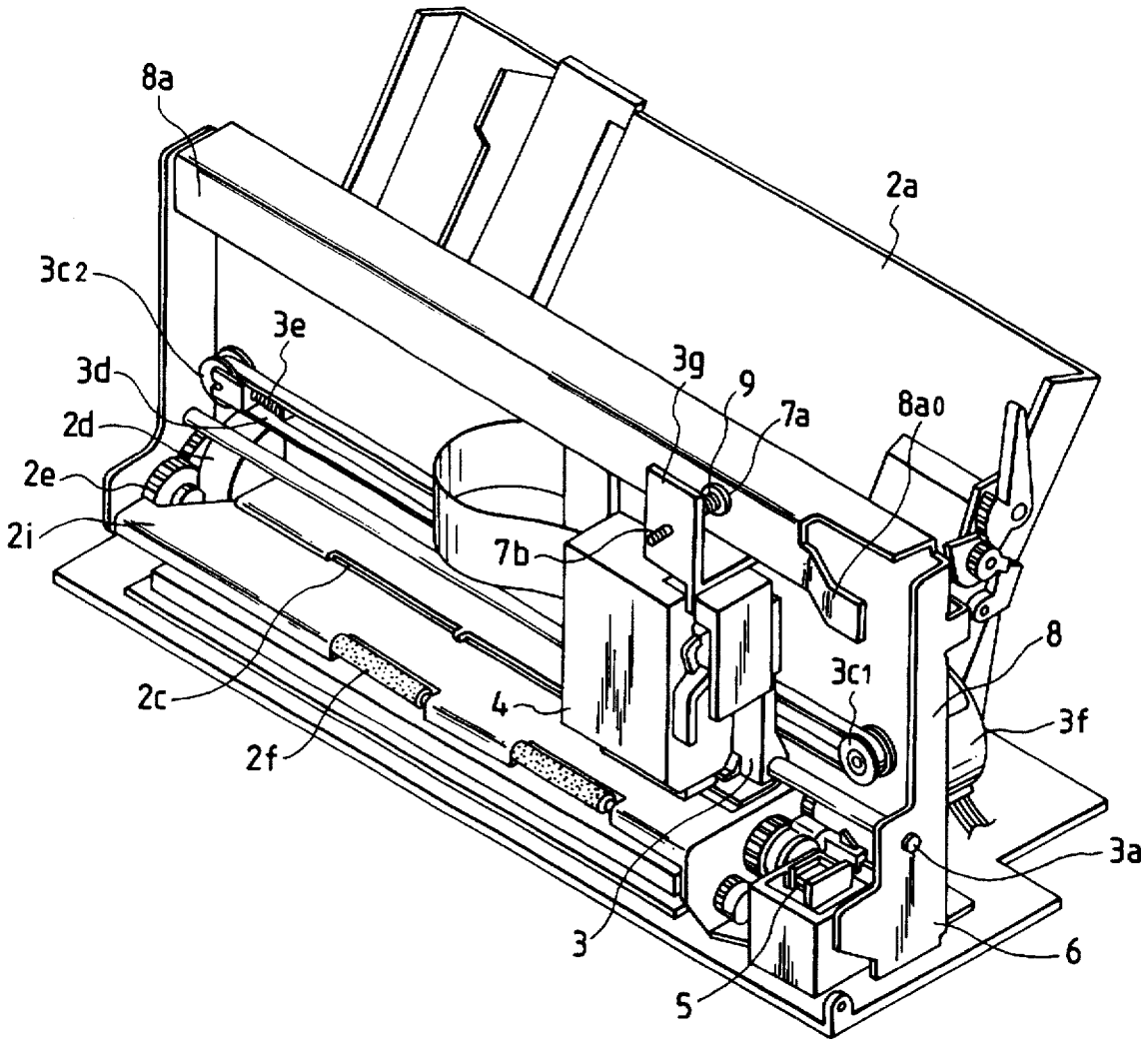
FIG. 5 is a schematic perspective explanation view of an ink jet recording apparatus according to the second embodiment of the invention.

Also, as shown in FIG. 5, the guide rail 8*a* is bent forth at a capping position located on the right side. Hence, when the carriage 3 is moved to the capping position, the carriage sliding portion 3*h* loses contact with the guide rail 8*a*, and the carriage 3 is forced toward a direction of the arrow B by the spring 9 fitted between the guide member 3*g* and the sliding member 7, and rotated around the guide shaft 3*a* in a direction of the arrow A on the guide rail 8*a* bent protruding forth (8a0) at a capping position as shown in FIG. 5, so that the ink discharge face 4*a* is caused to approach to a position facing the cap 5*a* to establish contact therewith.

Figure 4:
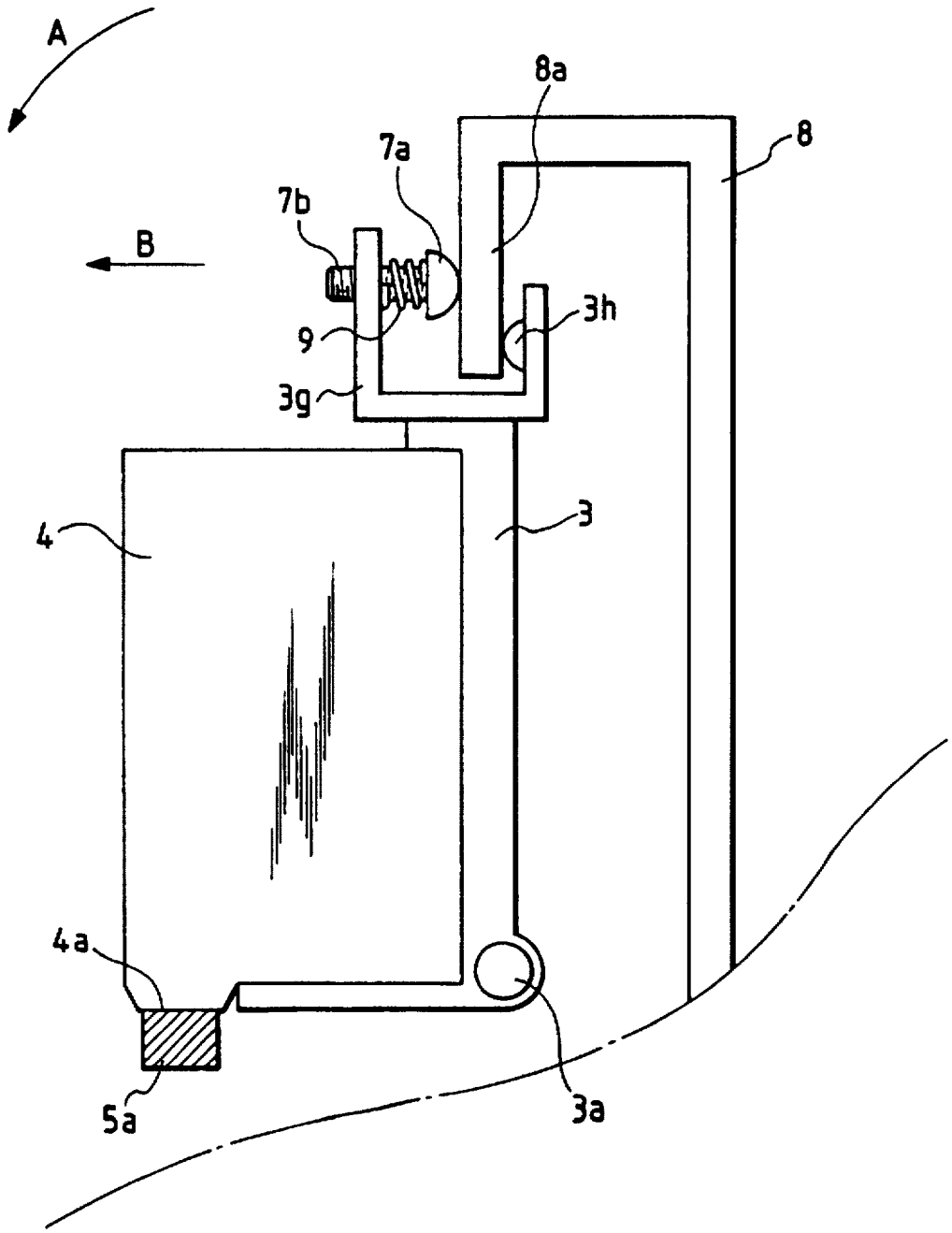
FIG. 4 is a schematic cross-sectional explanation view showing the constitution of pressing means provided on a carriage according to the second embodiment of the invention.

With the above constitution, the guide for the carriage 3 is made from a plate member such as a sheet metal, but there is a risk that the carriage 3 may fluctuate leftward or rightward in FIG. 4 during the reciprocative movement because of the tolerance or longitudinal dispersion of plate thickness for the guide rail 8*a*. However, the sliding portion 7*a* is brought into contact with the guide rail 8*a* by the spring 9 fitted between the guide member 3*g* and the sliding member 7 to always press the carriage 3 on the guide rail 8*a* and absorb the fluctuation therein, resulting in the stable reciprocative movement of the carriage 3. Note that the guide rail 8*a* may not be integrally formed with the chassis 8.

[Third embodiment]

A third embodiment other than the ink jet recording apparatus as shown in the first embodiment will be described below with reference to FIGS. 6 and 7. A schematic constitution of the ink jet recording apparatus is the same as that of the first embodiment, and the like numerals are attached to the like parts, the explanation of which is omitted. Note that FIG. 7 is a plan view from the above of the carriage as shown in FIG. 6.

This embodiment is configured such that a carriage 3 is reciprocated along a plate-like guide rail 8*a* formed by bending a part of a chassis 8 like a -character in cross section, as in the second embodiment, and the gap between the ink discharge face of a recording head 4 and the recording medium 1 (hereinafter referred to as a "paper gap") can be changed.

Figure 6:
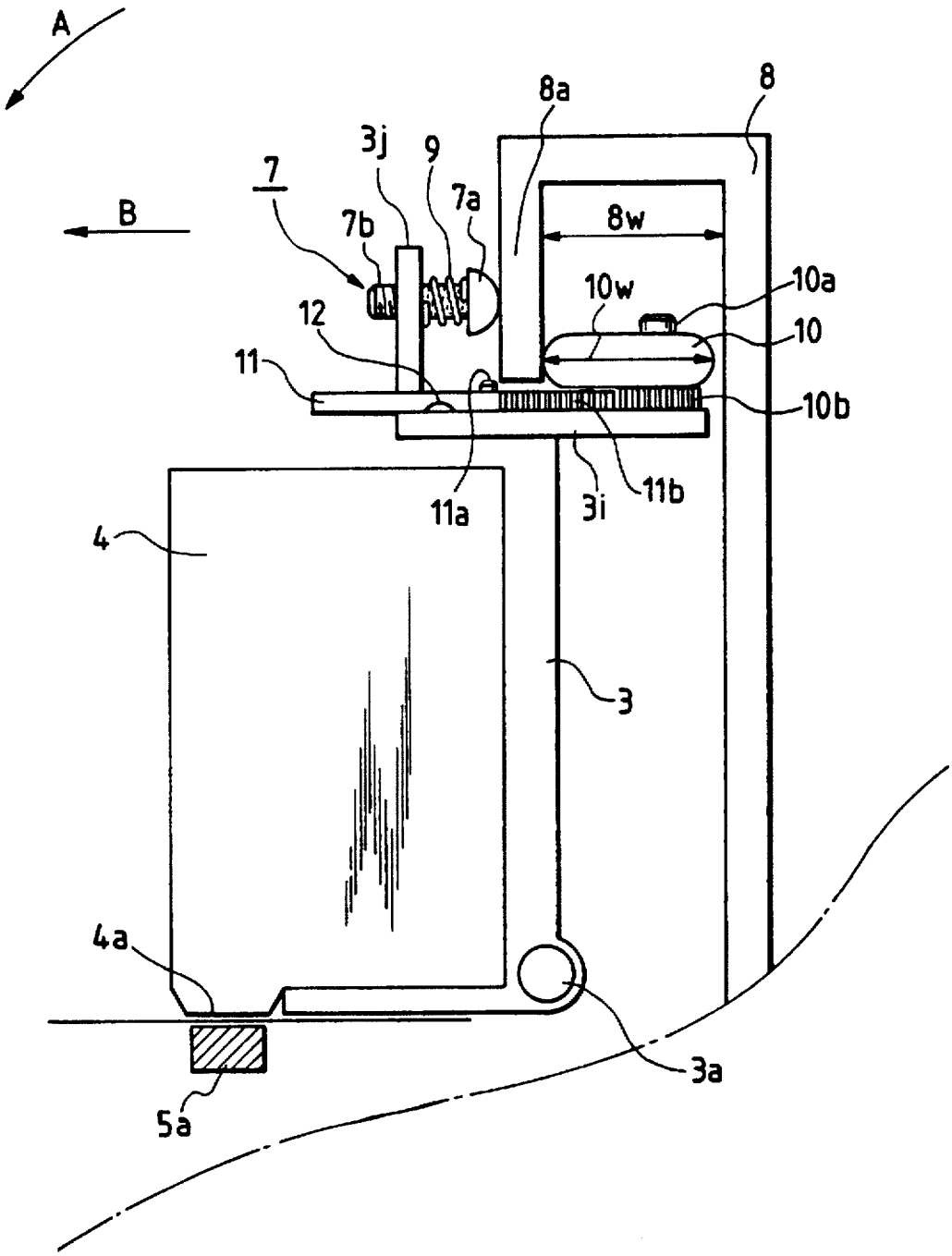
FIG. 6 is a schematic cross-sectional explanation view showing the constitution of pressing means provided on a carriage according to the third embodiment of the invention.
Figure 7:
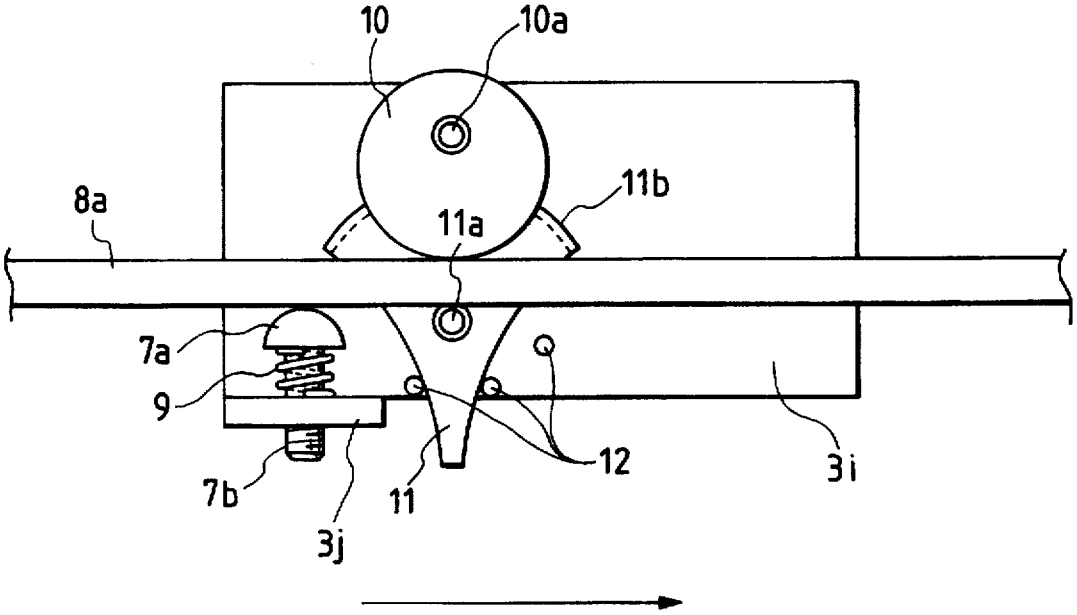
FIG. 7 is a schematic plan view from the above of the carriage as shown in FIG. 6.

In FIGS. 6 and 7, on the upper face of the carriage 3 is attached a guide member 3*i* on which a shaft 10*a* is provided, the shaft 10*a* having a gap adjusting cam 10 mounted rotatably. The gap adjusting cam 10 is mounted eccentrically to the shaft 10*a*, and a cam gear 10*b* is integrally mounted under the gap adjusting cam 10. Further, on the guide member 3*i*, an adjusting lever 11 is rotatably mounted around a shaft 11*a*, and a lever gear 11*b* formed on the circular surface of the adjusting lever 11 is mated with the cam gear 10*b*. The adjusting lever 11 has a concave portion formed on the back side thereof, which secures the position of the adjusting lever 11 upon engagement with a click 12 formed on the upper surface of the guide member 3*i*.

Through an upstanding surface 3*j* of the guide member 3*i*, a sliding member 7 is inserted to be slidable in left and right directions in FIG. 6. This sliding member 7 has a pin-like slide portion 7*b* and a semi-spherical sliding portion 7*a* for sliding with its spherical face abutting on the guide rail 8*a*. A spring 9 is fitted around the slide portion 7*b* between the upstanding surface 3*j* and the sliding portion 7*a* to force the sliding portion 7*a* into contact with the guide rail 8*a*.

With the above constitution, if the adjusting lever 11 is rotated in a direction of the arrow in FIG. 7, the gap adjusting cam 10 is rotated clockwise around the shaft 10*a*, because the lever gear 11*b* is mated with the cam gear 10*a*. Since the gap adjusting cam 10 is eccentric, the gap adjusting cam 10 has a variable radius around the shaft 10*a*, and urges the guide rail 8*a* toward a direction of the arrow B at the maximum radius thereof to cause the carriage 3 to be rotated via the sliding member 7 around the guide shaft 3*a* in a direction of the arrow A, as shown in FIG. 6. As a result, the ink discharge face 4*a* of the recording head 4 is directed downward to permit a narrower paper gap. Also, if the adjusting lever 11 is rotated in a direction opposite to the direction of the arrow in FIG. 7, the ink discharge face 4*i* a is directed upward to permit a wider gap between the recording head 4 and the recording medium 1. This makes it possible to convey and record on a variety of kinds of recording medium 1 having different thicknesses, resulting in the improved generality.

If the diameter 10W of the gap adjusting cam 10 is equal to the interval 8W between the chassis 8 and the guide rail 8*a*, the carriage 3 can be reciprocated stably (without fluctuation) along the guide shaft 3*a*. However, since the gap adjusting cam 10 must be slidable on the guide rail 8*a* of the chassis 8, there is necessarily a minute gap between the gap adjusting cam 10 and the guide rail 8*a* or the chassis 8. Also, there is a risk that the carriage 3 may fluctuate leftward or rightward in FIG. 6 during the reciprocative movement due to the tolerance or longitudinal dispersion of plate thickness for the guide rail 8*a*. However, the sliding portion 7*a* is brought into contact with the guide rail 8*a* by the spring 9 fitted between the upstanding surface 3*j* and the sliding member 7 to always press the carriage 3 on to the guide rail 8*a*, and absorb the fluctuation, so that the carriage 3 can be reciprocated stably though the adjustment of paper gap may be made.

[Fourth Embodiment]

A fourth embodiment other than the ink jet recording apparatus as shown in the first embodiment will be described below with reference to FIGS. 8 to 10. A schematic constitution of the ink jet recording apparatus is the same as that of the first embodiment, and the like numerals are attached to the like parts, the explanation of which is omitted. Note that FIGS. 9 and 10 are plan views from the above of the carriage as shown in FIG. 8.

This embodiment is different from the third embodiment but is configured like the third embodiment in that the gap between the ink discharge face 4*a* of the recording head 4 and the recording medium 1 (hereinafter referred to as a "paper gap") can be adjusted. Its constitution will be described in the following.

Figure 8:
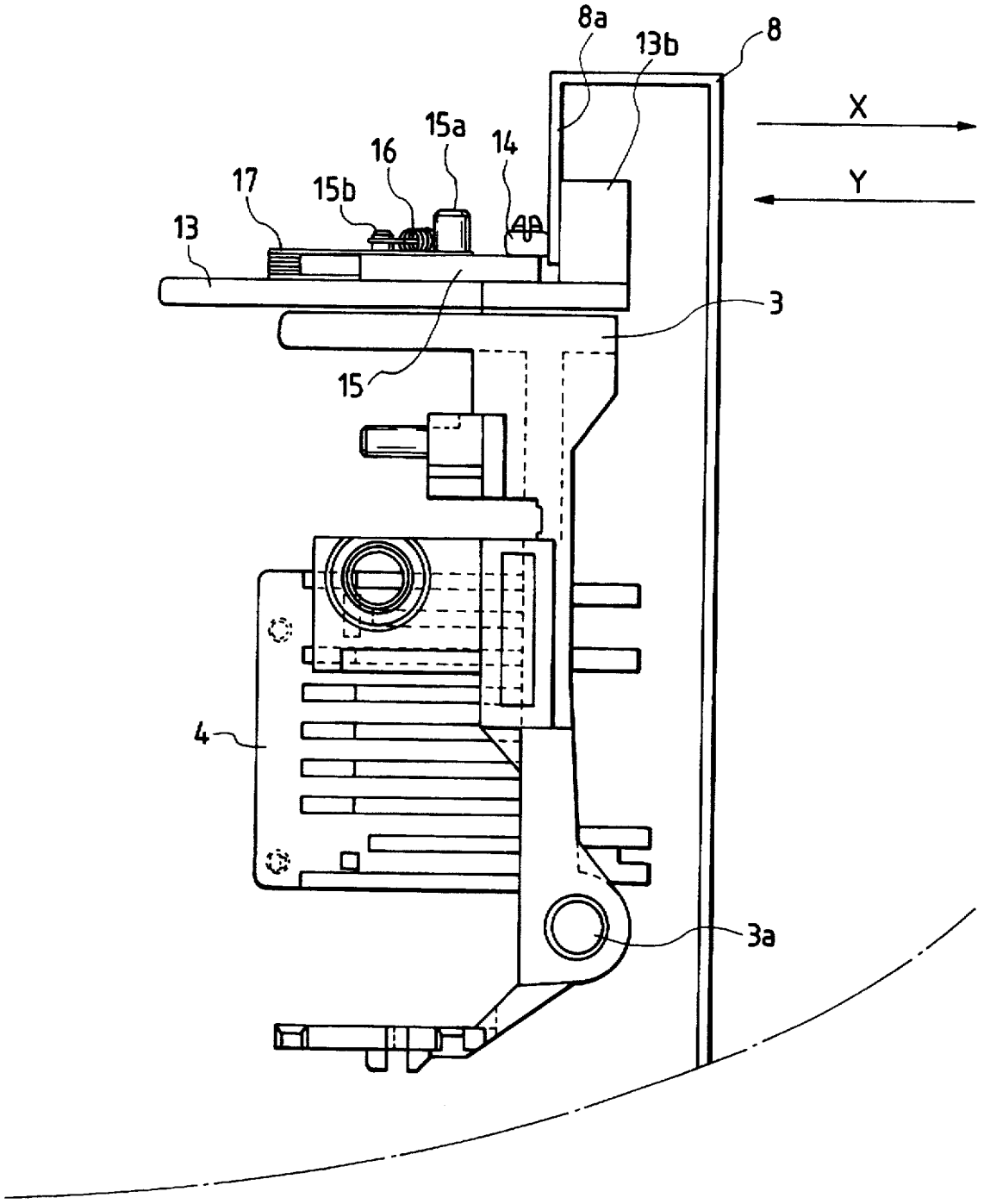
FIG. 8 is a schematic cross-sectional explanation view showing the constitution of pressing means provided on a carriage according to the fourth embodiment of the invention.
Figure 9:
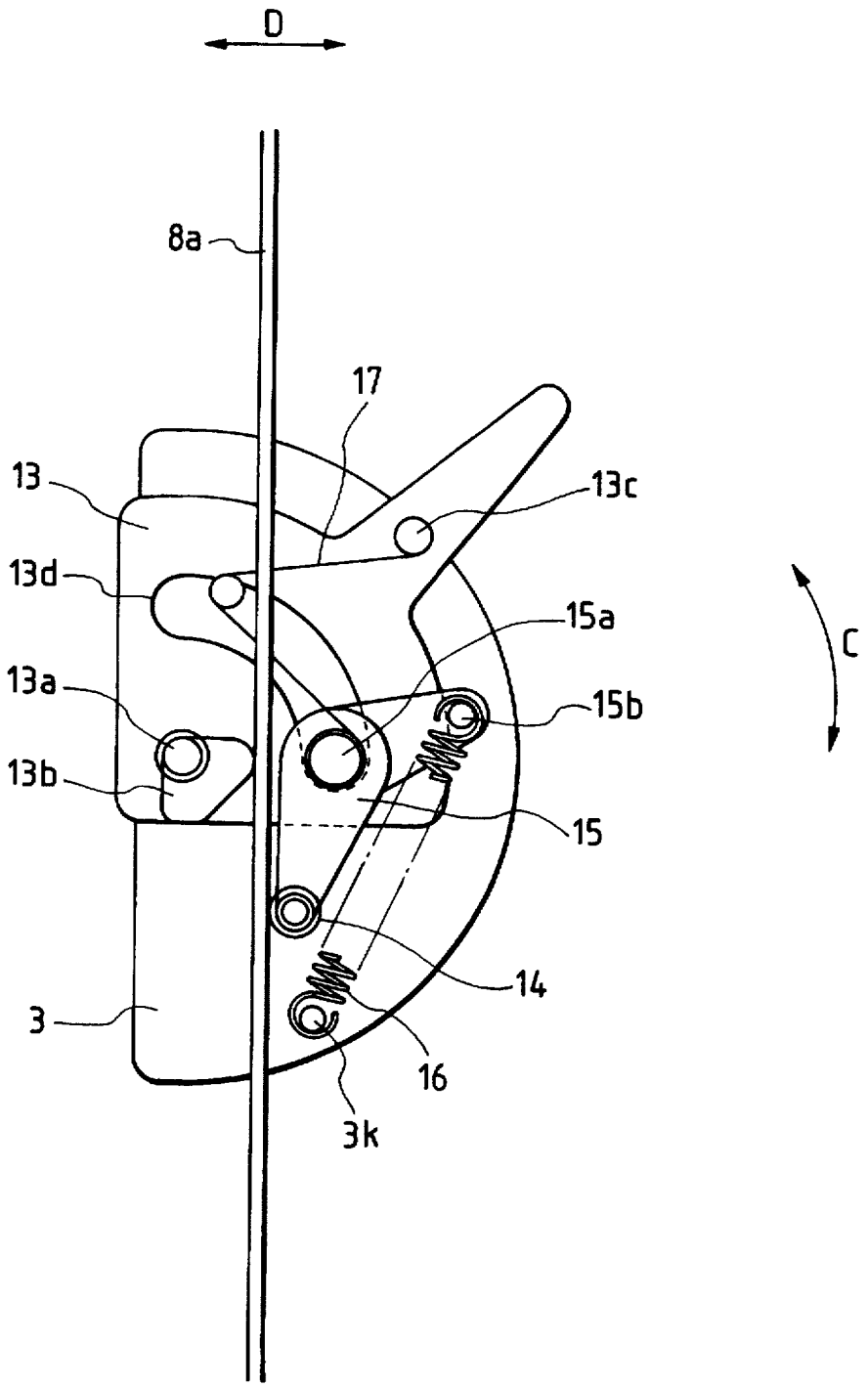
FIG. 9 is a schematic plan view showing the operation of pressing means.
Figure 10:
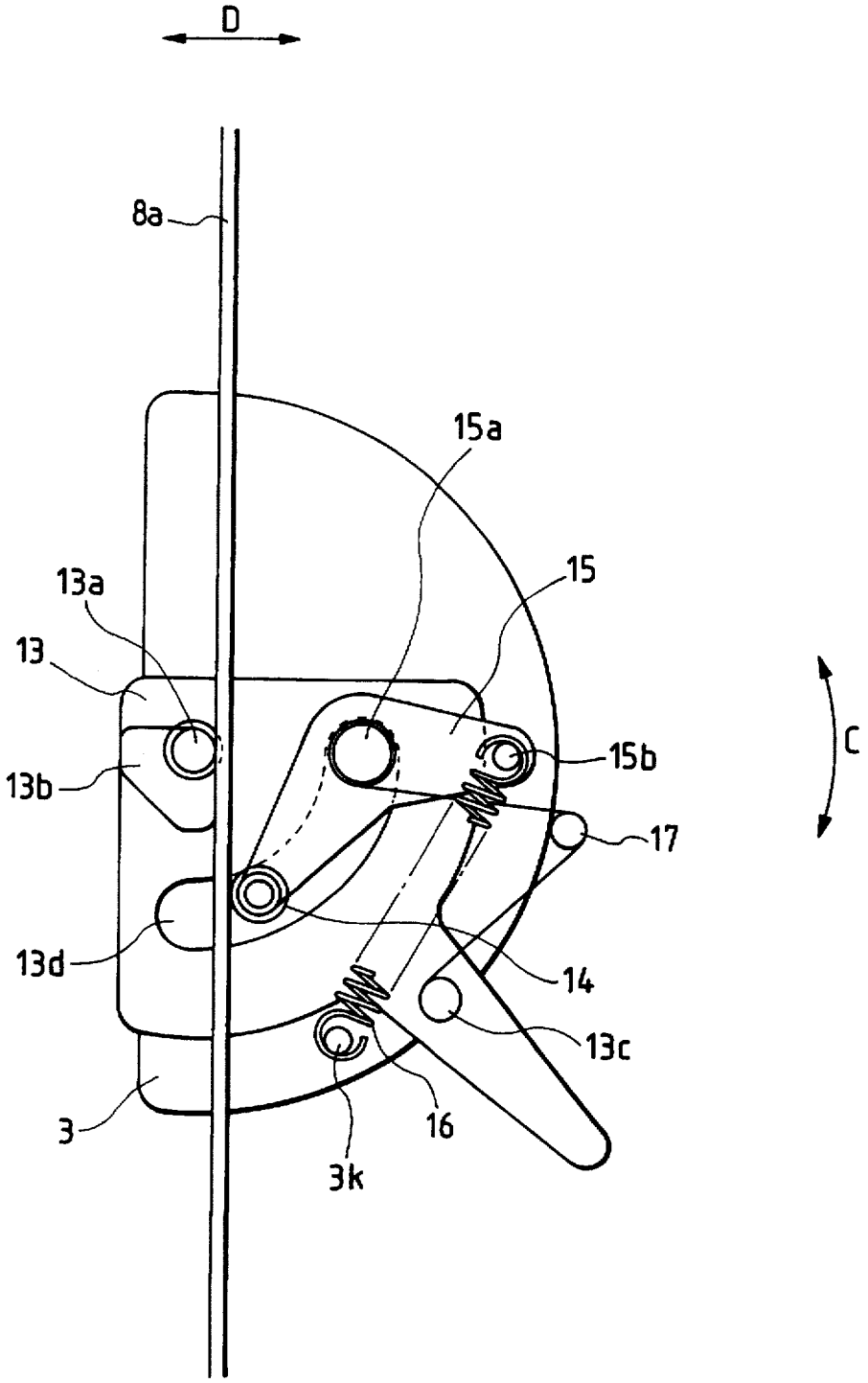
FIG. 10 is a schematic plan view showing the operation of pressing means.
Figure 11:
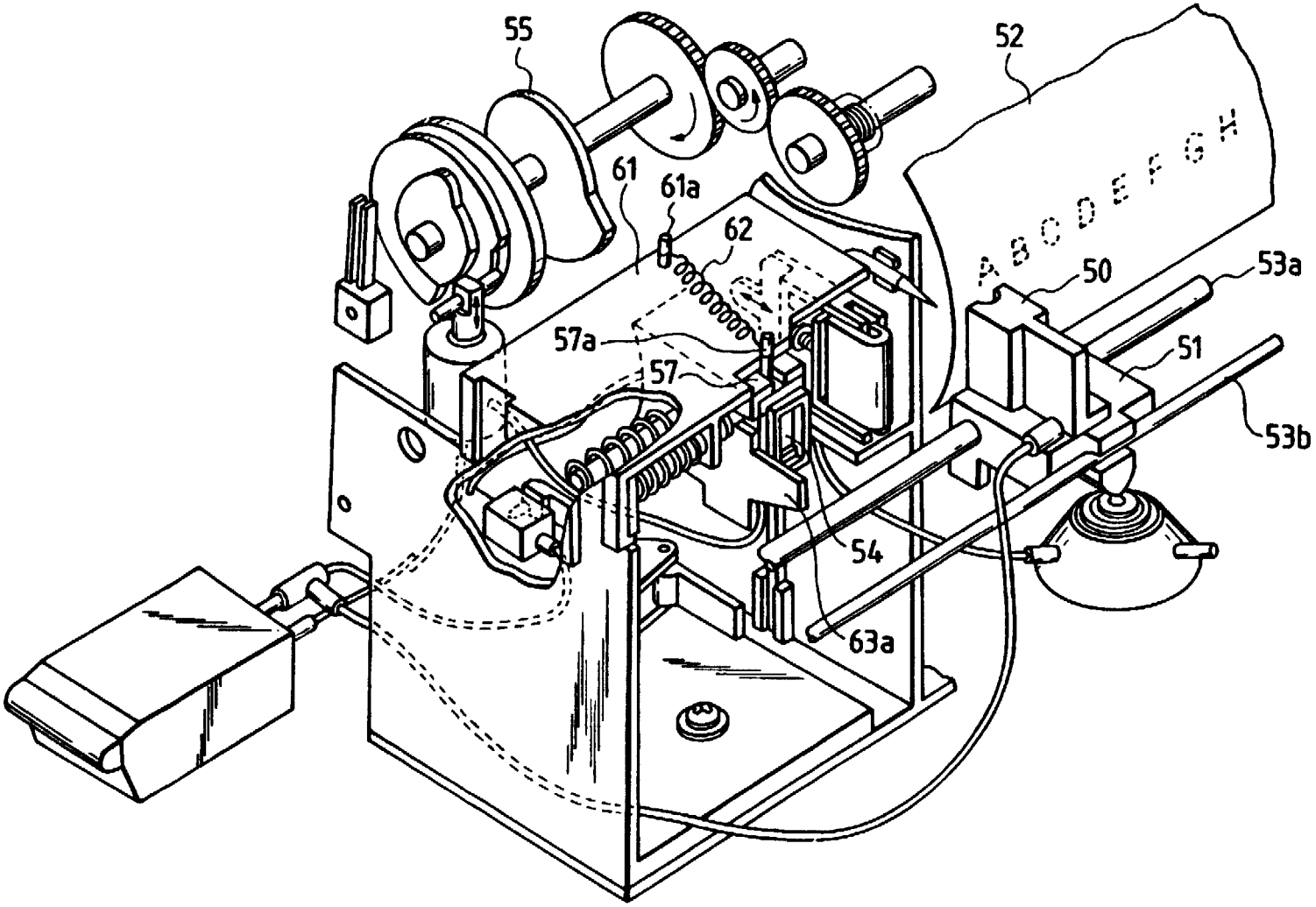
FIG. 11 PRIOR ART
FIG. 11 is a schematic perspective explanation view of a conventional ink jet recording apparatus.
Figure 12:
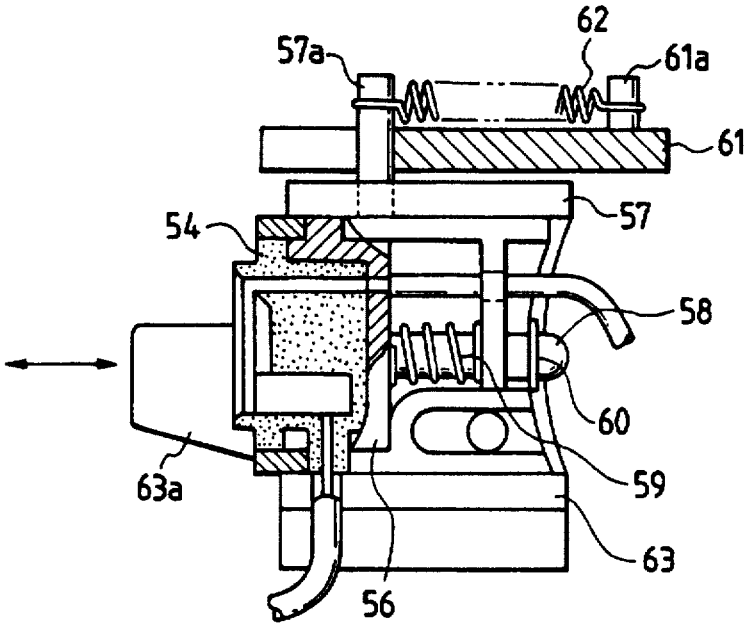
FIG. 12 PRIOR ART
FIG. 12 is a schematic cross-sectional explanation view of conventional recovery means.
Figure 13:
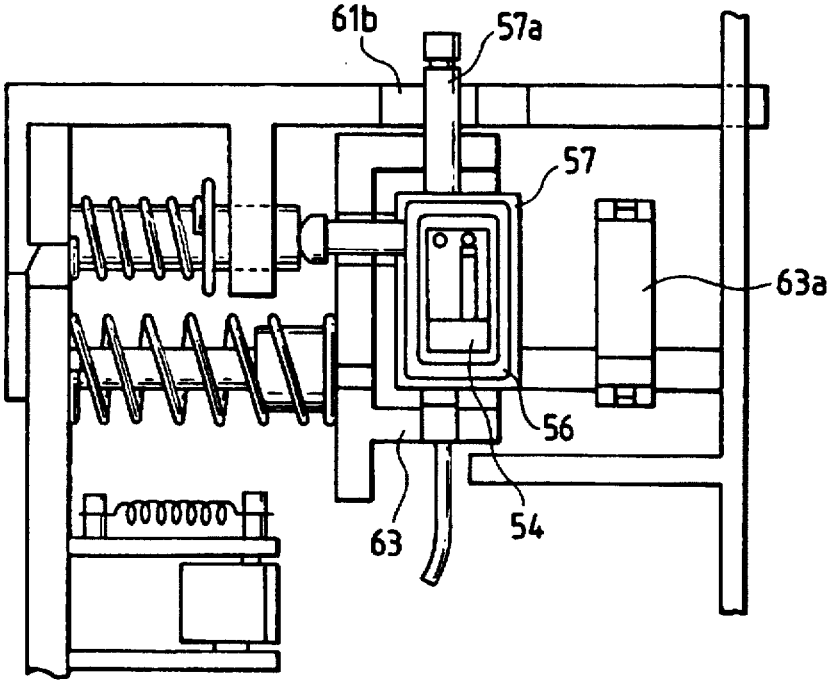
FIG. 13 PRIOR ART
FIG. 13 is a schematic front explanation view of conventional recovery means.

In FIGS. 8 and 9, on the upper face of a carriage 3 is attached an adjusting lever 13 mounted rotatably around a shaft 13*a* in a direction of the arrow C. An adjusting lever cam 13*b* of a triangular prism shape is attached coaxially with the adjusting lever 13, and rotated along with the movement of the adjusting lever 13 while being always in direct contact with a guide rail 8*a*. Depending on the stop position of the adjusting lever 13, the distance from the shaft 13*a* to the peripheral surface of the adjusting lever cam 13*b* is changed, so that the carriage 3 is moved in a direction of the arrow D in FIG. 9.

14 is a pressure contact roller which rolls on the rail along with the movement of the carriage 3, while pressing on the guide rail 8*a*. 15 is a pressure contact lever, which is rotatably mounted around a pressure contact lever shaft 15*a* provided on the upper surface of the carriage 3. The pressure contact lever 15 has the pressure contact roller 14 rotatably held at one end thereof. At the other end of the pressure contact lever 15 is provided a projection 15*b*, and between the projection 15*b* and a projection 3*k* on the upper surface of the carriage 3 is stretched a pressure contact spring 16, which urges the pressure contact lever 15 to cause the pressure contact roller 14 to always press on the guide rail 8*a*.

Note that a click spring 17 is provided between a projection 13*c* provided on the adjusting lever 13 and the pressure contact lever shaft 15*a* to hold the adjusting lever 13 at a position as shown in FIG. 9 or FIG. 10. Also, the adjusting lever 13 has a circular longitudinal hole 13*d* formed, as shown in FIG. 9, whereby the adjusting lever 13 can be rotated in a range where the end portion of the longitudinal hole 13*d* is not engaged by the pressure contact lever shaft 15*a*.

With the above constitution, if the adjusting lever 13 is rotated counterclockwise until the longitudinal hole 13*d* is engaged by the pressure contact lever shaft 15*a*, as shown in FIG. 9, the distance between the shaft 13*a* and the peripheral surface of the adjusting lever cam 13*b* becomes maximum, so that the carriage 3 is moved in a direction of the arrow X as shown in FIG. 8, and slightly rotated clockwise around the guide shaft 3*a*, resulting in a wider paper gap.

Next, if the adjusting lever 13 is rotated clockwise to a position at which the pressure contact lever shaft 15*a* engages the longitudinal hole 13*d*, as shown in FIG. 10, the distance between the shaft 13*a* and the peripheral surface of the adjusting lever cam 13*b* becomes minimum, so that the carriage 3 is moved in a direction of the arrow Y as shown in FIG. 8, and slightly rotated counterclockwise around the guide shaft 3*a*, resulting in a narrower paper interval.

With the above constitution, it is possible to provide the same effects as with the third embodiment.

[Fifth Embodiment]

While in the above-described embodiments, recording means used the ink jet recording system, it is more preferable that the recording means is constituted in such a manner as to energize electricity-heat converters in accordance with a recording signal, and discharge the ink through discharge orifices by growth and shrinkage of bubbles occurring in the ink due to film boiling produced by heat energy applied by the electricity-heat converters.

As to its representative constitution and principle, for example, one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleus boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic.

As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging orifice, liquid channel, and electricity-heat converter (linear liquid channel or right-angled liquid channel) as disclosed in the above-mentioned respective specifications, the constitution by use of U.S. Pat. No. 4,558,333 or 4,459,600 disclosing the constitution having the heat acting portion arranged in the flexed region is also included in the present invention.

In addition, the present invention can be also effectively made the constitution as disclosed in Japanese Patent Application Laid-Open No. 59-123670 which discloses the constitution using a slit common to a plurality of electricity-heat converters as the discharting portion of the electricity-heat converter or Japanese Patent Application Laid-Open No. 59-138461 which discloses the constitution having the opening for absorbing pressure wave of heat energy correspondent to the discharging portion. That is, the present invention makes it possible to realize the secure and efficient recording, in whatever form the recording head may be configured.

Further, the present invention can be effectively applied to the recording head of the full line type having a length corresponding to the maximum width of a recording medium which can be recorded by the recording device. As such a recording head, either the constitution which satisfies its length by a combination of a plurality of recording heads or the constitution as one recording head integrally formed may be used.

In addition, among the serial-type recording heads as above described, the present invention is effective for a recording head fixed to the carriage, a recording head of the freely exchangeable chip type which enables electrical connection to the main device or supply of ink from the main device by being mounted on the carriage, or a recording head of the cartridge type having an ink tank integrally provided on the recording head itself.

Also, addition of a restoration means for the recording head, a preliminary auxiliary means, etc., provided as the constitution of the recording device of the present invention is preferable, because the effect of the present invention can be further stabilized. Specific examples of these may include, for the recording head, capping means, cleaning means, pressurization or suction means, electricity-heat converters or another type of heating elements, or preliminary heating means according to a combination of these, and it is also effective for performing stable recording to perform preliminary mode which performs discharging separate from recording.

As for the types or number of recording heads to be mounted on the carriage, the present invention is effective to a single recording head provided corresponding to the monocolor ink or a plurality of recording heads corresponding to a plurality of inks having different recording colors or densities, for example. That is, as the recording mode of the recording device, the present invention is extremely effective for not only the recording mode only of a primary color such as black, etc., but also a device equipped with at least one of plural different colors or full color by color mixing, whether the recording head may be either integrally constituted or combined in plural number.

In addition, though the ink is considered as the liquid in the embodiments as above described, another ink may be also usable which is solid below room temperature and will soften or liquefy at or above room temperature, or liquefy when a recording signal is issued during use as it is common with the ink jet device to control the viscosity of ink to be maintained within a certain range of the stable discharge by adjusting the temperature of ink in a range from 30° C. to 70° C. In addition, in order to avoid the temperature elevation due to heat energy by positively utilizing the heat energy as the energy for the change of state from solid to liquid, or to prevent the evaporation of ink by using the ink which will stiffen in the shelf state, the use of the ink having a property of liquefying only with the application of heat energy, such as liquefying with the application of heat energy in accordance with a recording signal so that liquid ink is discharged, or may be solidified prior to reaching a recording medium, is also applicable in the present invention.

In such a case, the ink may be held as liquid or solid in recesses or through holes of a porous sheet, which is placed opposed to electricity-heat converters, as described in Japanese Patent Application Laid-Open No. 54-56847 or No. 60-71260. The most effective method for the ink as above described in the present invention is based on the film boiling.

Further, the ink jet recording apparatus as described above may be used as an image output terminal in an information processing equipment such as a computer, a copying machine in combination with a reader, or a facsimile terminal equipment having the transmission and reception feature.

As previously described, in this embodiment, recording head moving means for moving the recording head in a predetermined direction is provided with pressing means for pressing the ink discharge orifices of the recording head against the recovery means, and therefore the recovery means does not require pressing means for urging the ink discharge face of recording means, whereby the recovery means is simplified in construction with the easiness of assembly improved, and the apparatus is reduced in whole size with the lower costs because of the reduced number of components.

The pressing means provided on the recording head moving means can absorb the fluctuation occurring during the reciprocative movement of the recording head moving means to assure stable moving operation, and accordingly a mechanism for adjusting the interval between the recording means and the recording medium is provided to enhance the generality of the apparatus.

What is claimed is:

1. An ink jet recording apparatus for recording an image on a recording medium disposed above a platen with ink discharged from an ink discharge port of an ink jet recording head, said apparatus comprising:

a carriage for moving said ink jet recording head in a direction different from a conveyance direction of the recording medium;

a recovery mechanism having a contacting member for contacting a surface on which said discharge port of said ink jet head is provided;

a guide shaft for rotatably supporting and guiding said carriage, said guide shaft guiding said carriage to a recording area separate from said recording medium and to a positioning said carriage with respect to said recovery mechanism at a position where said contacting member is capable of contacting the surface on which said discharge port is provided by a rotational movement of said carriage with respect to said guide shaft; and a limiting mechanism for limiting the rotational movement of said carriage with respect to said guide shaft, said limiting mechanism having a guide surface and an elastic member for maintaining a position of said carriage with respect to said platen at said recording area by applying an elastic force to said guide surface, wherein said carriage is rotated and moved to the position where said contacting member is capable of contacting the surface on which said discharge port is provided by using at least the elastic force of said elastic member.

2. An ink jet recording apparatus according to claim 1, wherein said guide shaft is an axial member having a portion of smaller axial diameter than in other portions to guide said carriage to said recovery area.

3. An ink recording apparatus according to claim 1, wherein said guide shaft has a portion for guiding said carriage to said recovery area.

4. An ink jet recording apparatus according to claim 1, wherein said carriage has an adjusting mechanism for adjusting the internal between the recording medium and said ink discharge port in the recording area.

5. An ink jet recording apparatus according to claim 1, wherein said recovery mechanism comprises a cap member.

6. An ink jet recording apparatus according to claim 1, further comprising a conveying mechanism for conveying the recording medium to the recording area.

7. An ink jet recording apparatus for recording an image on a recording medium disposed above a platen with ink discharged from an ink discharge port of an ink jet recording head, said apparatus comprising:

a carriage for moving said ink jet recording head in a direction different from a conveyance direction of the recording medium;

a cap member for contacting a surface on which said discharge port of said ink jet head is provided to cover said discharge port;

a guide shaft for rotatably supporting and guiding said carriage, said guide shaft guiding said carriage to a recording area for recording on the recording medium and to a recovery area separate from said recording area and for positioning said carriage with respect to said cap member at a position where said cap member is capable of contacting the surface on which said discharge port is provided by a rotational movement of said carriage with respect to said guide shaft; and a limiting mechanism for limiting the rotational movement of said carriage with respect to said guide shaft, said limiting mechanism having a guide surface and an elastic member for maintaining a position of said carriage with respect to said platen at said recording area by applying an elastic force to said guide surface, wherein said carriage is rotated and moved in a direction of said cap member by using at least the elastic force of said elastic member and the surface on which said ink discharge port is provided is pressed to said carriage.

8. An ink jet recording apparatus according to claim 7, wherein said guide shaft is an axial member having a portion of smaller axial diameter than in other portions to guide said carriage to said recovery area.

9. An ink jet recording apparatus according to claim 7, wherein said guide shaft has a bent portion for guiding said carriage to said recovery area.

10. An ink jet recording apparatus according to claim 7, wherein said carriage has an adjusting mechanism for adjusting the interval between the recording medium and said ink discharge port in the recording area.

11. An ink jet recording apparatus according to claim 7, further comprising a conveying mechanism for conveying the recording medium to the recording area.

12. An ink jet recording apparatus for recording an image on a recording medium disposed above a platen with ink discharged from an ink discharge port of an ink jet recording head, said apparatus comprising:

a carriage for moving said ink jet recording head in a direction different from a conveyance direction of the recording medium;

a recovery mechanism having a contacting member for contacting a surface on which said discharge port of said ink jet head is provided;

a guide shaft for rotatably supporting and guiding said carriage, said guide shaft guiding said carriage to a recording area for recording on the recording medium and to recovery area separate from said recording area and for positioning said carriage with respect to said recovery mechanism at a position where said contacting member is capable of contacting the surface on which said discharge port is provided by a rotational movement of said carriage with respect to said guide shaft; and a limiting mechanism for limiting the rotational movement of said carriage with respect to said guide shaft, said limiting mechanism having a guide surface, an elastic member for maintaining a position of said carriage with respect to said platen at said recording area by applying an elastic force to said guide surface and a cam member for applying a contact pressure to a reverse side of said guide surface, wherein the contact pressure of said cam member is used to rotate and move said carriage so as to change a distance between said ink discharge port and said platen, and said carriage is rotated and moved to a position where said contacting member is capable of contacting the surface on which said discharge port is provided by using at least the elastic force of said elastic member.

13. An ink jet recording apparatus according to claim 12, wherein said guide shaft is an axial member having a portion of smaller axial diameter than in other portions to guide said carriage to said recovery area.

14. An ink jet recording apparatus according to claim 12, wherein said guide shaft has a bent portion for guiding said carriage to said recovery area.

15. An ink jet recording apparatus according to claim 12, wherein said carriage has an adjusting mechanism for adjusting the interval between the recording medium and said ink discharge port in the recording area.

16. An ink jet recording apparatus according to claim 12, wherein said recovery mechanism comprises a cap member.

17. An ink jet recording apparatus according to claim 12, further comprising a conveying mechanism for conveying the recording medium to the recording area.

18. An ink jet recording apparatus for recording an image on a recording medium disposed above a platen with ink discharged from an ink discharge port of an ink jet recording head, said apparatus comprising:

a carriage for moving said ink jet recording head in a direction different from a conveyance direction of the recording medium;

a recovery mechanism having a contacting member for contacting a surface on which said discharge port of said ink jet head is provided;

a guide shaft for rotatably supporting and guiding said carriage, said guide shaft guiding said carriage to a recording area for recording on the recording medium and to a recovery area separate from said recording area and for positioning said carriage with respect to said recovery mechanism at a position where said contacting member is capable of contacting the surface on which said discharge port is provided by a rotational movement of said carriage with respect to said guide shaft; and a limiting mechanism for limiting the rotational movement of said carriage with respect to said guide shaft, said limiting mechanism having a guide surface, an elastic member for maintaining a position of said carriage with respect to said platen at said recording area by applying an elastic force to said guide surface and a cam member for applying a contact pressure to a reverse side of said guide surface, wherein the contact pressure of said cam member is used to rotate and move said carriage so as to change a distance between said ink discharge port and said platen, said carriage is rotated and moved to a position where said contacting member is capable of contacting the surface on which said discharge port is provided by using at least the elastic force of said elastic member, and the rotational movement of said carriage at said recording area is smaller than that of said carriage at said recovery area.

19. An ink jet recording apparatus according to claim 18, wherein said guide shaft is an axial member having a portion of smaller axial diameter than in other portions to guide said carriage to said recovery area.

20. An ink jet recording apparatus according to claim 18, wherein said guide shaft has a bent portion for guiding said carriage to said recovery area.

21. An ink jet recording apparatus according to claim 18, wherein said carriage has an adjusting mechanism for adjusting the interval between the recording medium and said ink discharge port in the recording area.

22. An ink jet recording apparatus according to claim 18, wherein said recovery mechanism comprises a cap member.

23. An ink jet recording apparatus according to claim 18, further comprising a conveying mechanism for conveying the recording medium to the recording area.

24. An ink jet recording apparatus for recording an image on a recording medium disposed above a platen with ink discharged from an ink discharge port of an ink jet recording head, said apparatus comprising:

a carriage for moving said ink jet recording head in a direction different from a conveyance direction of the recording medium;

a recovery mechanism having a cover member for covering a surface on which said discharge port of said ink jet head is provided;

a guide shaft for rotatably supporting and guiding said carriage, said guide shaft guiding said carriage to a recording area for recording on the recording medium and to a recovery area separate from said recording area and for positioning said carriage with respect to said recovery mechanism at a position where said cover member is capable of covering the surface on which said discharge port is provided by a rotational movement of said carriage with respect to said guide shaft; and a limiting mechanism for limiting the rotational movement of said carriage with respect to said guide shaft, said limiting mechanism having a guide surface and an elastic member for maintaining a position of said carriage with respect to said platen at said recording area by applying an elastic force to said guide surface, wherein said carriage is rotated and moved to the position where said cover member is capable of covering the surface on which said discharge port is provided by using at least the elastic force of said elastic member.

25. An ink jet recording apparatus according to claim 24, wherein said guide shaft is an axial member having a portion of smaller axial diameter than in other portions to guide said carriage to said recovery area.

26. An ink jet recording apparatus according to claim 24, wherein said guide shaft has a bent portion for guiding said carriage to said recovery area.

27. An ink jet recording apparatus according to claim 24, wherein said carriage has an adjusting mechanism for adjusting the interval between the recording medium and said ink discharge port in the recording area.

28. An ink jet recording apparatus according to claim 24, wherein said recovery mechanism comprises a cap member.

29. An ink jet recording apparatus according to claim 24, further comprising a conveying mechanism for conveying the recording medium to the recording area.

30. An ink jet recording apparatus for recording an image on a recording medium disposed above a platen with ink discharged from an ink discharge port of an ink jet recording head, said apparatus comprising:

a carriage for moving said ink jet recording head in a direction different from a conveyance direction of the recording medium;

a cap member for capping said discharge port of said ink jet head to cover said discharge port;

a guide shaft for rotatably supporting and guiding said carriage, said guide shaft guiding said carriage to a recording area for recording on the recording medium and to a capping area separate from said recording area and for positioning said carriage with respect to said cap member at a position where said cap member is capable of covering said discharge port by a rotational movement of said carriage with respect to said guide shaft; and a limiting mechanism for limiting the rotational movement of said carriage with respect to said guide shaft, said limiting mechanism having a guide surface and an elastic member for maintaining a position of said carriage with respect to said platen at said recording area by applying an elastic force to said guide surface, wherein said carriage is rotated and moved to the position where said cap member is capable of covering said discharge port by using at least the elastic force of said elastic member.

31. An ink jet recording apparatus according to claim 30, wherein said guide shaft is an axial member having a portion of smaller axial diameter than in other portions to guide said carriage to said recovery area.

32. An ink jet recording apparatus according to claim 30, wherein said guide shaft has a bent portion for guiding said carriage to said recovery area.

33. An ink jet recording apparatus according to claim 30, wherein said carriage has an adjusting mechanism for adjusting the interval between the recording medium and said ink discharge port in the recording area.

34. An ink jet recording apparatus according to claim 30, further comprising a conveying mechanism for conveying the recording medium to the recording area.

* * * * *

UNITED STATES PATENT AND TRADEMARK OFFICE

CERTIFICATE OF CORRECTION

PATENT NO. : 5,751,301

DATED : May 12, 1998

INVENTOR(S) : SATOSHI SAIKAWA ET AL.

It is certified that error appears in the above-identified patent and that said Letters Patent is hereby corrected as shown below:

COLUMN 3

Line 27, "be now" should read --now be--.

COLUMN 4

Line 41, "an" should read --a--.

COLUMN 5

Line 21, "position" should read --positions--.

COLUMN 6

Line 7, "a-character" should read --a]-character--.

Line 9, "a-character" should read --a]-character--.

Line 61, "a-character" should read --a]-character--.

UNITED STATES PATENT AND TRADEMARK OFFICE

CERTIFICATE OF CORRECTION

PATENT NO. : 5,751,301

DATED : May 12, 1998

INVENTOR(S) : SATOSHI SAIKAWA ET AL.

It is certified that error appears in the above-identified patent and that said Letters Patent is hereby corrected as shown below:

COLUMN 7

Line 24, "gear 10a." should read --gear 10b.--

Line 34, "face 4i a" should read --face 4a--.

COLUMN 9

Line 8, "nucleus" should read --nucleate--.

Line 41, "discharting" should read --discharging--.

COLUMN 11

Line 19, "separate from said" should read --for recording on the--.

Line 20, "a positioning" should read --a recovery area separate from said recording area and for positioning--.

Line 45, "internal" should read --interval--.

UNITED STATES PATENT AND TRADEMARK OFFICE

CERTIFICATE OF CORRECTION

PATENT NO. : 5,751,301

DATED : May 12, 1998

INVENTOR(S) : SATOSHI SAIKAWA ET AL.

It is certified that error appears in the above-identified patent and that said Letters Patent is hereby corrected as shown below:

COLUMN 12

Line 42, "recovery" should read --a recovery--.

Signed and Sealed this

Fifteenth Day of December, 1998

Bruce Lehman

*Attest:*

BRUCE LEHMAN

*Attesting Officer*

*Commissioner of Patents and Trademarks*